US007158645B2

(12) United States Patent
June et al.

(10) Patent No.: US 7,158,645 B2
(45) Date of Patent: Jan. 2, 2007

(54) ORTHOGONAL CIRCULAR MICROPHONE ARRAY SYSTEM AND METHOD FOR DETECTING THREE-DIMENSIONAL DIRECTION OF SOUND SOURCE USING THE SAME

(75) Inventors: Sun-do June, Seoul (KR); Jay-woo Kim, Kyungki-do (KR); San-ryong Kim, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 640 days.

(21) Appl. No.: 10/395,104

(22) Filed: Mar. 25, 2003

(65) Prior Publication Data

US 2003/0185410 A1 Oct. 2, 2003

(30) Foreign Application Priority Data

Mar. 27, 2002 (KR) ..... 10-2002-0016692

(51) Int. Cl.
*H04R 3/00* (2006.01)

(52) U.S. Cl. ..... 381/92; 381/91; 381/122

(58) Field of Classification Search ..... 381/92, 381/180, 91, 94.3, 122, 356, 111, 112–115, 381/313; 367/129
See application file for complete search history.

(56) References Cited

U.S. PATENT DOCUMENTS 4,003,016 A 1/1977 Remley
4,696,043 A * 9/1987 Iwahara et al. ..... 381/92
5,490,599 A * 2/1996 Tohidi ..... 211/171
5,581,620 A 12/1996 Brandstein et al.
6,041,127 A * 3/2000 Elko ..... 381/92
6,069,961 A * 5/2000 Nakazawa ..... 381/92
6,504,490 B1 * 1/2003 Mizushima ..... 340/943

(Continued)

FOREIGN PATENT DOCUMENTS

JP A-60-90499 5/1985

(Continued)

OTHER PUBLICATIONS

Lee, A., et al., *Acoustic beamforming using a novel correlation technique*, Measurement Science and Technology, vol. 2, No. 3, Mar. 1991, Great Britain, pp. 229-237.

(Continued)

*Primary Examiner*—Xu Mei
(74) *Attorney, Agent, or Firm*—Buchanan Ingersoll & Rooney PC

(57) ABSTRACT

Provided are an orthogonal circular microphone array system for detecting a three-dimensional direction of a sound source, the system comprising a directional microphone which receives a speech signal from the sound source, a first microphone array in which a predetermined number of microphones for receiving the speech signal from the sound source are arranged around the directional microphone, a second microphone array in which a predetermined number of microphones for receiving the-speech signal from the sound source are arranged around the directional microphone so as to be orthogonal to the first microphone array, a direction detection unit which receives signals from the first and second microphone arrays, discriminates whether the signals are speech signals and estimates the location of the sound source, a rotation controller which changes the direction of the first microphone array, the second microphone array, and the directional microphone according to the location of the sound source estimated by the direction detection unit, and a speech signal processing unit which performs an arithmetic operation on the speech signal received by the directional microphone and the speech signal received by the first and second microphone arrays and outputs a resultant speech signal, and a method for estimating a speaker's three-dimensional location.

16 Claims, 7 Drawing Sheets

U.S. PATENT DOCUMENTS

| | | | | |
|---|---|---|---|---|
| 6,618,485 | B1 * | 9/2003 | Matsuo | 381/92 |
| 6,845,163 | B1 * | 1/2005 | Johnston et al. | 381/92 |

FOREIGN PATENT DOCUMENTS

| | | |
|---|---|---|
| KR | P2000-0013290 | 3/2000 |
| WO | WO 94/26075 | 11/1994 |
| WO | WO 02/03754 A1 | 1/2002 |

OTHER PUBLICATIONS

Notice to Submit Response issued by the Korean Patent Office in corresponding application 10-2002-0016692 on May 21, 2004.

Hariharan, Ramalingam et al., "*Robust End-of-Utterance Detection for Real-Time Speech Recognition Application*," IEEE pp. 249-252(2001).

Caminero, J., et al. "*On-line Garbage Modeling with Discriminant Analysis for Utterance Verification*," Speech Technology Group, Madrid, Spain.

Notice to Submit Response issued by the Japanese Patent Office on Jan. 27, 2005 in corresponding application.

* cited by examiner

ORTHOGONAL CIRCULAR MICROPHONE ARRAY SYSTEM AND METHOD FOR DETECTING THREE-DIMENSIONAL DIRECTION OF SOUND SOURCE USING THE SAME

BACKGROUND OF THE INVENTION

This application claims the priority of Korean Patent Application No. 2002-16692, filed on Mar. 27, 2002, in the Korean Intellectual Property Office, the disclosure of which is incorporated herein in its entirety by reference.

1. Field of the Invention

The present invention relates to a system and method for detecting a three-dimensional direction of a sound source.

2. Description of the Related Art For understanding of the present invention, a sound source, which is an object of direction estimation of the present invention, will be referred to as a speaker and will be illustratively described below.

Microphones generally receive a speech signal in all directions. In a conventional microphone referred to as an omnidirectional microphone, an ambient noise and an echo signal as well. as a speech signal to be received are received and may distort a desired speech signal. A directional microphone is used to solve the problem of the conventional microphone.

The directional microphone receives a speech signal only Within a predetermined angle (directional angle) with respect to an axis of the microphone. Thus, when a speaker speaks at the microphone within the directional angle of the directional microphone, a speaker's speech signal louder than the ambient noise is received by the microphone, while a noise outside the directional angle of the microphone is not received.

Recently, the directional microphone is often used in teleconferences. However, because of the characteristics of the directional microphone, the speaker should speak at the microphone only within the directional angle of the microphone. That is, the speaker cannot speak while sitting or moving in a conference room outside the directional angle of the microphone.

In order to solve the above and related problems, a microphone array system which receives a speaker's speech signal, while the speaker moves in a predetermined space, by arranging a plurality of microphones at a predetermined interval, has been proposed.

A planar type microphone array system as shown in FIG. 1A is installed in a predetermined space and receives a speaker's speech signal while the speaker moves toward the system. That is, the planar type microphone array system receives a speaker's speech signal while the speaker moves within a range of about 180° in front of the system. Thus, when the speaker moves behind the microphone array system, the planar type microphone array system cannot receive a speaker's speech signal.

A circular type microphone array system which overcomes these major limitations of the planar type microphone array system, is shown in FIG. 1B. The circular type microphone array system receives a speaker's speech signal while the speaker moves within a range of 360° from the center of a plane where the microphone is installed. However, when the microphone plane is the XY plane, the circular type microphone array system considers a speaker's location only in the XY plane while the Z axis location of the speaker is not considered. As such, the microphone receives signals from all planar directions and a noise and an echo signal generated along the Z axis, and thus there is still distortion of the speech signals.

SUMMARY OF THE INVENTION

The present invention provides a microphone array system and a method for efficiently receiving a speaker's speech signal in a multiple direction in which the speaker speaks, in consideration of a speaker's three-dimensional movement as well as a speaker's location which moves in a plane.

The present invention also provides a microphone array system and a method for improving speech recognition by maximizing a received speaker's speech signal, minimizing an ambient noise and an echo signal as well as a speaker's speech signal and recognizing speaker's speech more clearly.

According to an aspect of the present invention, there is provided an orthogonal circular microphone array system for detecting a three-dimensional direction of a sound source. The system includes a directional microphone which receives a speech signal from the sound source, a first microphone array in which a predetermined number of microphones for receiving the speech signal from the sound source are arranged around the directional microphone, a second microphone array in which a predetermined number of microphones for receiving the speech signal from the sound source are arranged around the directional microphone so as to be orthogonal to the first microphone array, a direction detection unit which receives signals from the first and second microphone arrays, discriminates whether the signals are speech signals and estimates the location of the sound source, a rotation controller which changes the direction of the first microphone array, the second microphone array, and the directional microphone according to the location of the sound source estimated by the direction detection unit, and a speech signal processing unit which performs an arithmetic operation on the speech signal received by the directional microphone and the speech signal received by the first and second microphone arrays and outputs a resultant speech signal.

According to another aspect of the present invention, there is provided a method for detecting a three-dimensional direction of a sound source using first and second microphone arrays in which a predetermined number of microphones are arranged, and a directional microphone. The method comprises (a) discriminating a speech signal from signals that are inputted from the first microphone array, (b) estimating the direction of the sound source according to an angle at which a speech signal is received to a microphone installed in the first microphone array and rotating the second microphone array so that microphones installed in the second microphone array orthogonal to the first microphone array face the estimated direction, (c) estimating the direction of the sound source according to an angle at which the speech signal is inputted to the microphones installed in the second microphone array, (d) receiving the speech signal by moving the directional microphone in the direction of the sound source estimated in steps (b) and (c) and outputting the received speech signal, and (e) detecting change of the location of the sound source and whether speech utterance of the sound source is terminated.

BRIEF DESCRIPTION OF THE DRAWINGS

The above and other aspects and advantages of the present invention will become more apparent by describing in detail preferred embodiments thereof with reference to the attached drawings in which.

DETAILED DESCRIPTION OF THE INVENTION

Hereinafter, preferred embodiments of the present invention will be described in detail, examples of which are illustrated in the accompanying drawings.

Figure 1A:
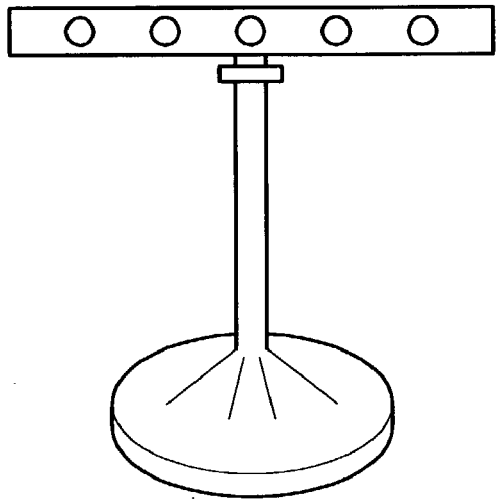
FIG. 1A (PRIOR ART)
FIGS. 1A and 1B show the structures of conventional microphone array systems.
Figure 1B:
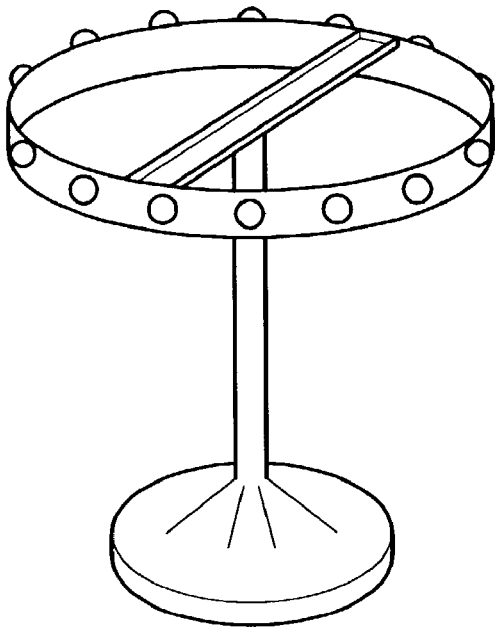
FIG. 1B (PRIOR ART)
Figure 2A:
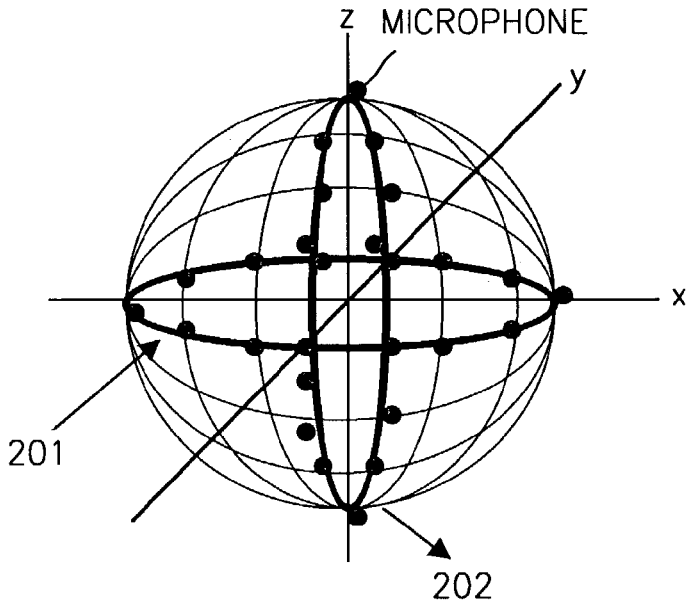
FIG. 2A shows the structure of an orthogonal circular microphone array system according to the present invention.
Figure 2B:
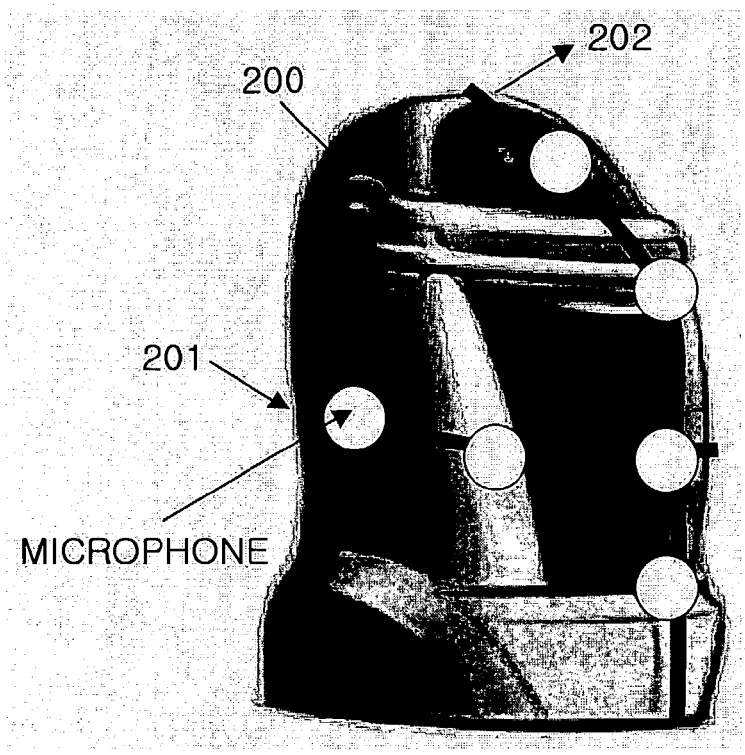
FIG. 2B shows an example in which the orthogonal circular microphone array system of FIG. 2A is adopted to a robot.

FIG. 2A shows the structure of an orthogonal circular microphone array system according to the present invention, and FIG. 2B shows an example in which the orthogonal circular microphone array of FIG. 2A is adopted to a robot.

According to the present invention, a latitudinal circular microphone array 201 and a longitudinal circular microphone array 202 are arranged to be physically orthogonal to each other in a three-dimensional spherical structure, as shown in FIG. 2A. The microphone array system can be implemented on various structures such as a robot or a doll, as shown in FIG. 2B.

Figure 2C:
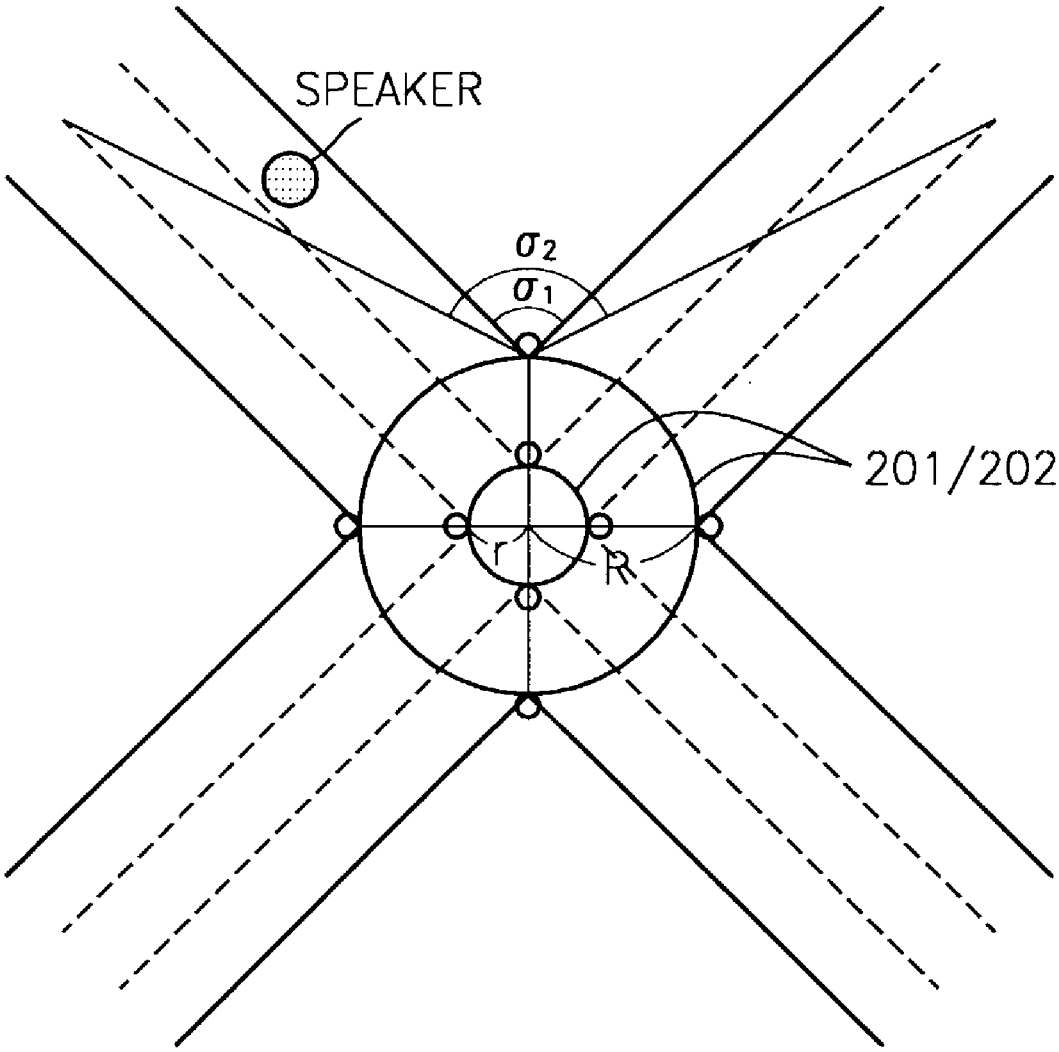
FIG. 2C shows the operating principles of a microphone array system.

Each of the latitudinal circular microphone array 201 and the longitudinal circular microphone array 202 is constituted by circularly arranging a predetermined number of microphones in consideration of a directional angle of a directional microphone and the size of an object on which a microphone array is to be implemented. As shown in FIG. 2C, assuming that the directional angle $\sigma_1$ of one directional microphone attached to a circular microphone array structure is 90° and the radius of the circular microphone array structure is R, if four directional microphones are installed in the circular microphone array structure, a speech signal of a speaker placed beyond the directional angle of the microphone is not received by any of the microphones attached to the microphone array.

However, when the directional angle of the microphone is greater than 90° (when the directional angle of the microphone is $\sigma_2$) or the radius of the microphone array is smaller than R (when the radius of the microphone array is r), a speech signal of the speaker in the same locations is received by one microphone attached to the microphone array. As shown in FIG. 2C, the microphone array should be constituted in consideration of the directional angle of the microphones attached to the microphone array, a distance from the speaker, and the size of an object on which the microphone array is to be implemented. If the microphone array includes minimum $$\left(\frac{2\pi}{\sigma}+1\right)$$

microphones according to the directional angle σ of the directional microphone, a speaker's location within a range of 360° can be detected, but a predetermined distance between the object on which the microphone array is implemented and the speaker should be maintained.

The latitudinal circular microphone array 201 shown in FIG. 2A receives a speech signal from the speaker on the XY plane so that a speaker's two-dimensional location on the XY plane can be estimated. If the speaker's two-dimensional location on the XY plane is estimated, the longitudinal microphone array 202 rotates toward the estimated two-dimensional location and receives a speech signal from the speaker so that a speaker's three-dimensional location can be estimated.

Figure 3:
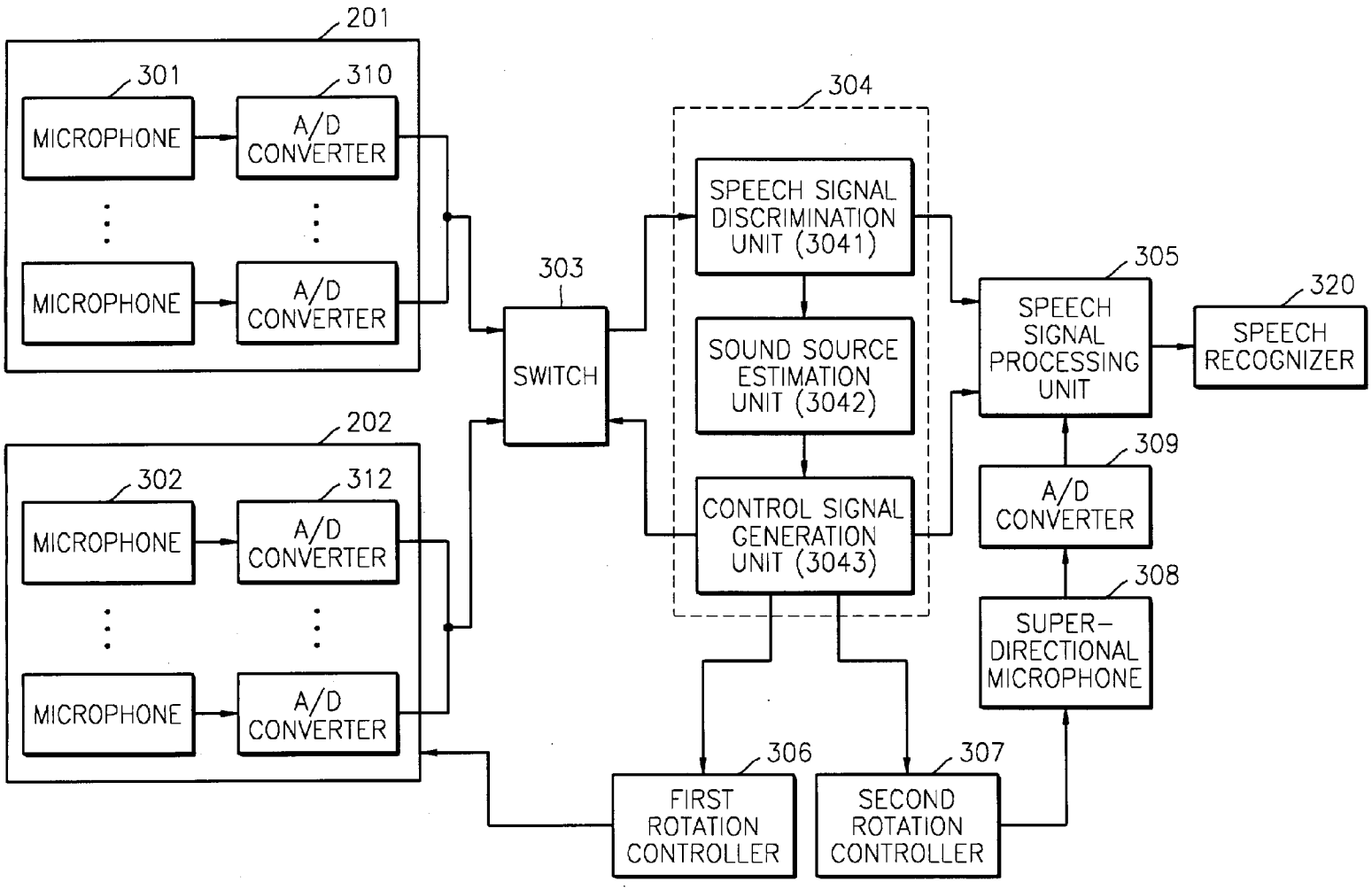
FIG. 3 shows a block diagram of the structure of the orthogonal circular microphone array system according to the present invention.

Hereinafter, the structure of a microphone array system according to the present invention which estimates a speaker's location using two orthogonally arranged circular microphone arrays and receives a speaker's speech signal, will be described with reference to FIG. 3.

The microphone array system according to the present invention includes a latitudinal circular microphone array 201 which receives a speaker's speech signal in a two-dimensional direction on an XY plane, a longitudinal circular microphone array 202 which receives a speaker's speech signal in a three-dimensional direction on a YZ plane toward the estimated speaker's two-dimensional location, a direction detection unit 304 which estimates a speaker's location from the signal received by the latitudinal circular microphone array 201 and the longitudinal circular microphone array 202 and outputs a control signal therefrom, a switch 303 which selectively transmits a speech signal inputted from the latitudinal circular microphone array 201 and a speech signal inputted from the longitudinal circular microphone array 202 to the direction detection unit 304, a super-directional microphone 308 which receives a speech signal from the estimated speaker's location, a speech signal processing unit 305 which enhances a speech signal received by the super-directional microphone 308 and the longitudinal circular microphone array 202, a first rotation controller 306 which controls a rotation direction and an angle of the longitudinal circular microphone array 202, and a second rotation controller 307 which controls the rotation direction and angle of the super-directional microphone 308.

In addition, the direction detection unit 304 includes a speech signal discrimination unit 3041 which discriminates a speech signal from signals received by the latitudinal circular microphone array 201 and the longitudinal circular microphone array 202, a sound source direction estimation unit 3042 which estimates the direction of a sound source from the speech signal received by the speech signal discrimination unit 3041 according to a reception angle of a speech signal inputted from the latitudinal and longitudinal circular microphone arrays 201 and 202, and a control signal generation unit 3043 which outputs a control signal for rotating the longitudinal circular microphone array 202 from the direction estimated by the sound source direction estimation unit 3042, outputs a control signal for determining when the inputted microphone array signal is to be switched to the switch 303, and outputs a control signal for determining when the enhanced speech signal is to be applied to the speech signal processing unit 305.

Figure 4:
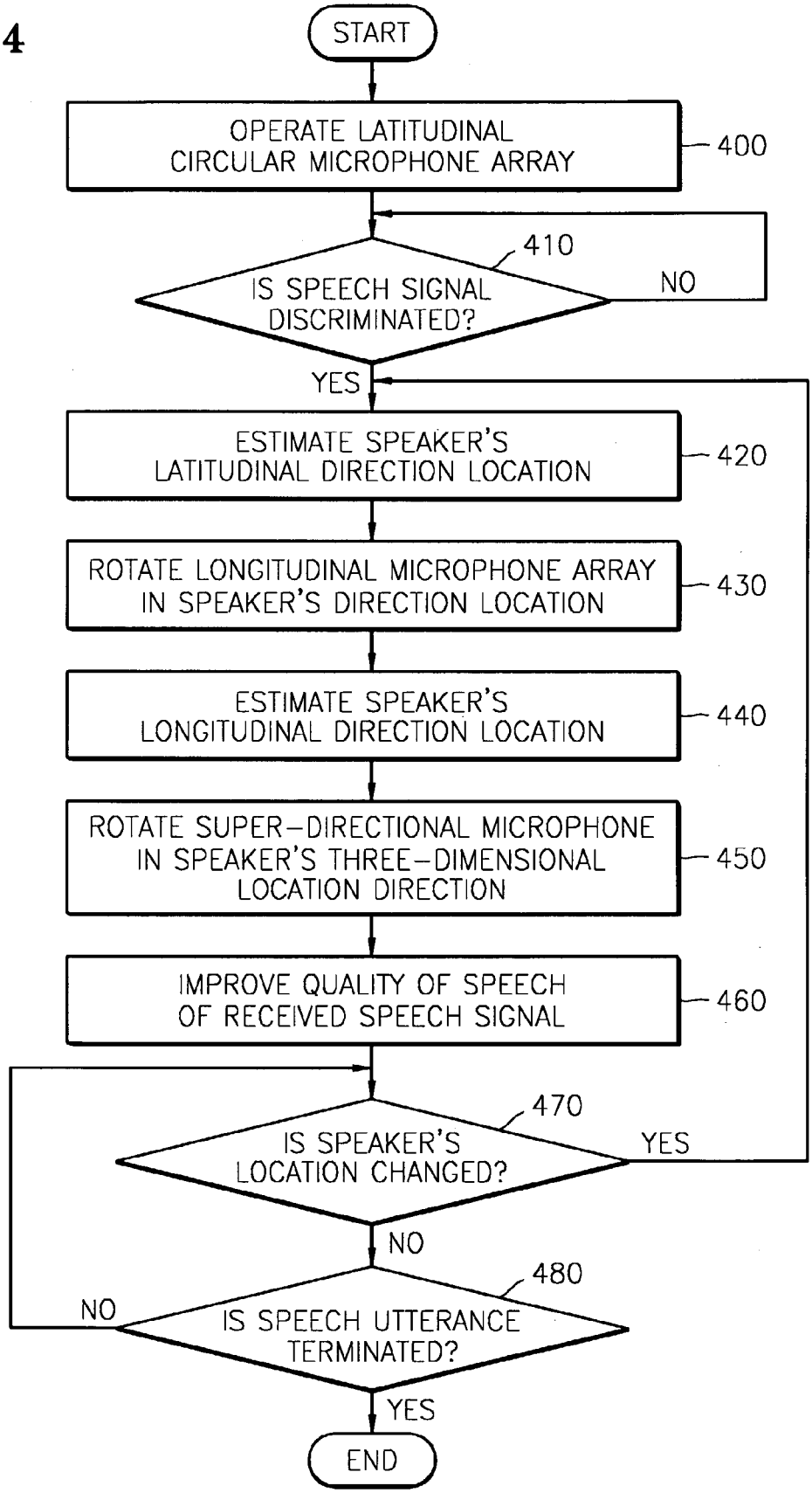
FIG. 4 shows a flowchart illustrating a method for detecting a three-dimensional direction of a sound source according to the present invention.

Hereinafter, a method for estimating a speaker's location according to the present invention will be described with reference to FIGS. 3 and 4.

In step 400, if power is applied to the microphone array system according to the present invention, the latitudinal circular microphone array 201 operates first and receives a signal from an ambient environment. The directional microphones that are installed in the latitudinal microphone array 201 receive signals that are inputted within a directional angle, and the received analog signals are converted into digital signals by an A/D converter 309 and are applied to the switch 303. During an initial operation, the switch 303 transmits signals that are inputted from the latitudinal circular microphone array 201 to the direction detection unit 304.

In step 410, the speech signal discrimination unit 3041 included in the direction detection unit 304 discriminates whether there is a speech signal in the digital signals that are inputted through the switch 303. Considering the object of the present invention, the improvement of speech recognition by clearly receiving a human speech signal through the microphone array, it is very important that the speech signal discrimination unit 3041 precisely detects only a speech signal duration among the signals that have been presently inputted from the microphone 301 and inputs the speech signal duration to a speech recognizer 320 through the speech signal processing unit 305.

Speech recognition can be largely classified into two functions: a function to precisely check an instant at which a speech signal is received, after a nonspeech duration continues, and to precisely inform a starting instant of the speech signal, and a function to precisely check an instant at which a nonspeech duration starts, after a speech duration continues, and to inform an ending instant of the speech signal; the following technologies to perform these functions are widely known.

First, in a method for performing a function to inform an ending instant of a speech signal, signals inputted through a microphone are split according to a predetermined frame duration (i.e., 30 ms), and the energy of the signals is calculated, and if an energy value becomes much smaller than the previous energy value, it is determined that a speech signal is not generated any more, and the determined time is processed as an ending instant of the speech signal. In this case, if only one fixed value is used as a critical value for determining that the energy becomes much smaller than the previous energy value, a difference between speech in a loud voice and speech in a soft voice can be ignored. Thus, a method in which the previous speech duration is observed, its critical value is adaptively changed and it is detected whether the signal that has been presently received is speech using the critical value, has been proposed. Such a method was proposed in the article "Robust End-of-Utterance Detection for Real-time Speech Recognition Applications" by Hariharan, R. Hakkinen, J. Laurila, K. in IEEE International Conference on Acoustics, Speech and Signal Processing Proceedings. 2001, Volume 1, pp. 249–252.

Another well-known method in relation to speech recognition is a method which constitutes a garbage model with respect to an out-of-vocabulary (OOV) in advance, considers how a signal inputted through a microphone is suitable for the garbage mode, and determines whether the signal is a garbage or a speech signal. This method constitutes the garbage model by previously learning sound other than speech, considers how a signal that has been presently received is suitable for the garbage model, and determines a speech/non-speech duration. A method which estimates a relation between noise speech and non-noise speech using a neural network and linear recurrence analysis and removes a noise by conversion, has also been proposed in the article "On-line Garbage Modeling with Discriminant Analysis for Utterance Verification" by Caminero, J. De La Torre, D. Villarrubia, L. Martin, C. Hernandez, L. in Fourth International Conference on Spoken Language ICSLP Proceedings, 1996, Vol. 4, pp. 2111~2114.

Using the above-mentioned methods, if a speech signal value over a predetermined level is not inputted through the latitudinal circular microphone array 201, the speech signal discrimination unit 3041 determines that the current speech is not inputted. If a speech signal value over a predetermined level is detected by a plurality of the microphones 301 installed in the latitudinal circular microphone array 201, i.e., n microphones, and a signal value is not inputted from the remaining microphones, it is determined that a speech signal is detected and the speaker exists within the range of $(n+1)\times\sigma$ (directional angle), and the inputted signal is outputted and applied to the sound source direction detection unit 3042.

A method for estimating a speaker's direction will be described with reference to FIGS. 5A and 5B.

When a speech signal inputted from a speaker to the microphone array according to the present invention reaches each of the microphones 301 and 302 that are installed in the latitudinal and longitudinal circular microphone arrays 201 and 202, the speech signal is received at predetermined time delays with respect to the first receiving microphone. The time delays are determined according to a directional angle $\sigma$ of the microphone and a speaker's location, that is, an angle $\theta$ with respect to a microphone at which the speech signal is inputted.

In the present embodiment, in consideration of the characteristics of the directional microphone, in case of a microphone by which a speech signal is received at less than a predetermined signal level, it is determined that the speaker does not exist within the direction angle of the corresponding microphone, and angles of corresponding microphones are excluded from a speaker's location estimation angle.

Figure 5A:
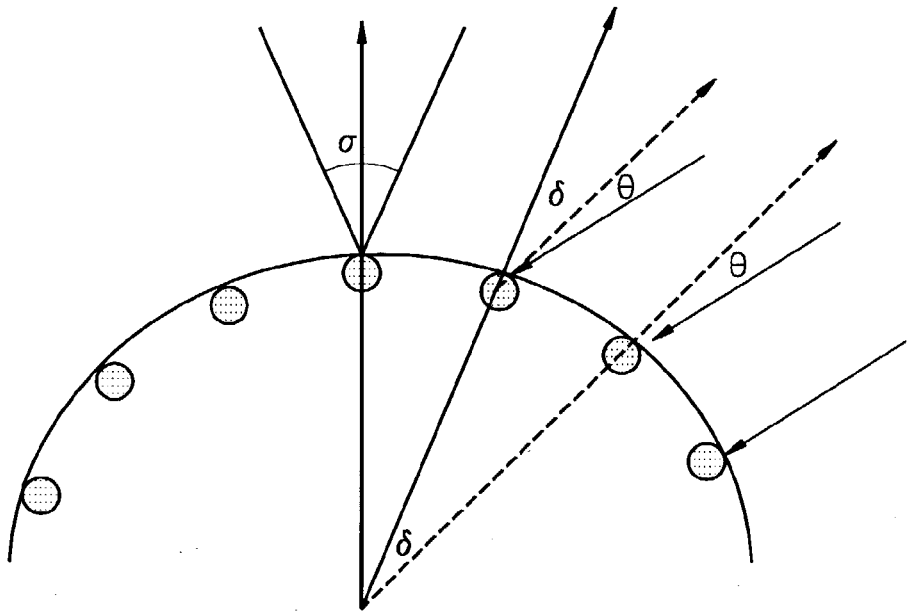
FIG. 5A shows an example in which the angle of a sound source is analyzed to estimate the direction of the sound source according to the present invention.
Figure 5B:
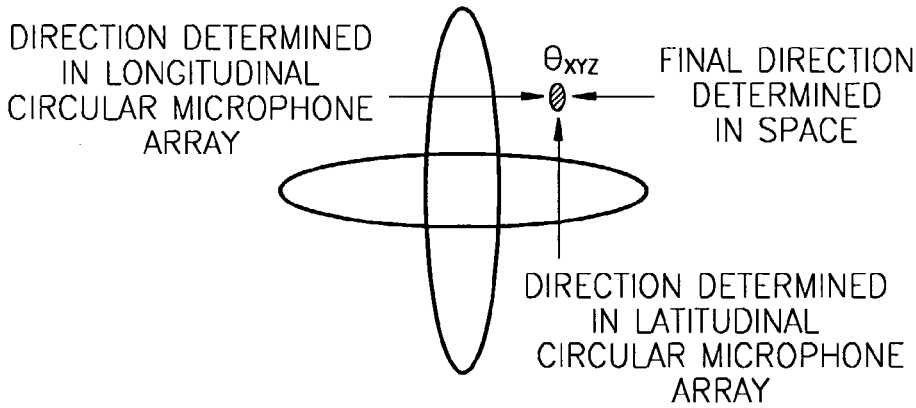
FIG. 5B shows a speaker's location finally determined.

The sound source direction estimation unit 3042 measures the angle $\theta$ , at which a speaker's speech signal is received, from an imaginary line (reference line) connecting the directional microphone centered on the center of the microphone array on the basis of one directional microphone, as shown in FIG. 5A, so as to estimate a speaker's location. For microphones other than reference microphones, an angle of a speech signal received by the microphone from the imaginary line parallel to the reference line is measured. If an object on which the array is implemented does not make a sound much greater than the sound source, an incident angle $\theta$ of a speech signal received by each microphone for receiving a speech signal may be substantially the same.

After all sounds over a predetermined level received by a microphone are added, converted into a frequency region through a fast Fourier transform (FFT) conversion, the received sounds are converted into a region of $\theta$, $\theta$ having the maximum power value represents the direction along which the speaker is placed.

When a received speech signal inputted to an n-th microphone with a predetermined time delay in a time region is $x_n(t)$, and an output signal to which a speech signal value of each of the microphones is added is y(t), y(t) is obtained by Equation 1.

$$y(t) = \sum_{n=1}^{M} x_n(t + delay_n) \tag{1}$$

$$= \sum_{n=1}^{M} x_n\left(t + (n-1)\frac{2r\sin\left(\frac{\pi}{M}\right)\cos\left(\theta + \frac{2\pi(n-1)}{M}\right)}{c}\right)$$

Here, Y(f) obtained by converting y(t) into a frequency region is as follows.

$$Y(f) = \sum_{n=1}^{M} X_n(f)\exp\left(j2\pi f_{speech}(n-1)\frac{2r\sin\left(\frac{\pi}{M}\right)\cos\left(\theta + \frac{2\pi(n-1)}{M}\right)}{c}\right) \tag{2}$$

Here, c represents the sound velocity in a medium in which a speech signal is transmitted from a sound source, δ represents an interval between the microphones that are installed in the array, M represents the number of microphones that are installed in the array, θ represents an incident angle of a speech signal received by the microphone, and $$\delta = \frac{2\pi}{M}$$

is formed.

Y(f) converted into the frequency region is expressed by a variable θ , that is, Y(f) is converted into a region of θ , and then the energy of a speech signal received in the region of θ is obtained by Equation 3.

$$P(\theta, k; m) = \left|\sum_{n=1}^{M} X_i(k; m)\exp\left(j2\pi f_{speech}(n-1)\frac{2r\sin\left(\frac{\pi}{M}\right)\cos\left(\theta + \frac{2\pi(n-1)}{M}\right)}{c}\right)\right| \tag{3}$$

Here, θ is between 0 and π , and when Y(f) is converted into the region of θ , the frequency region is converted into the region of θ so that the negative maximum value of sound in the frequency region is mapped to 0° in the region of θ , 0° in the frequency region is mapped from the region of θ to $$\frac{(n+1)\times\delta}{2},$$

the positive maximum value in the frequency region is mapped from the region of θ to (n+1)×δ.

The output energy function of θ is known by P(θ , k; m), as an output of the microphone array, and θ at the maximum output can be determined. As such, an intensity power in a direct path of a received speech signal can be known. If the above Equations 1, 2, and 3 are combined with respect to all frequencies k, a power spectrum value P(θ;m) is as follows.

$$P(\theta; m) = \sum_{k=0}^{K-1}\left|\sum_{n=1}^{M} X_i(k; m)\exp\left(j2\pi f_{speech}(n-1)\frac{2r\sin\left(\frac{\pi}{M}\right)\cos\left(\theta + \frac{2\pi(n-1)}{M}\right)}{c}\right)\right|^2 \tag{4}$$

In conclusion, in step 420, when a speaker's direction having the maximum energy in all frequency regions is given by $\theta_s$ , the speaker's direction can be determined as $\theta_s = \text{argmax}_\theta P(\theta ; m)$.

As described above, if a two-dimensional location in a speaker's latitudinal direction is estimated from a speech signal inputted from the latitudinal circular microphone array 201, the sound source direction estimation unit 3042 outputs a speaker's direction $\theta_s$ detected by the control signal generation unit 3043. The control signal generation unit 3043 outputs a control signal to the first rotation controller 306 so that the longitudinal circular microphone array 202 is rotated in the speaker's direction $\theta_s$. The first rotation controller 306 rotates the longitudinal circular microphone array 202 in the direction given by $\theta_s$ so that the longitudinal microphone array 202 faces directly the speaker in a two-dimensional direction. Preferably, the latitudinal circular microphone array 201 and the longitudinal circular microphone array 202 rotate together when the longitudinal circular microphone array 202 rotates in the speaker's direction. In this case, in step 430, if a microphone array system commonly used for the latitudinal circular microphone array 201 and the longitudinal circular microphone array 202 faces the speaker, this case can be determined as proper rotation.

Meanwhile, if the rotation of the latitudinal circular microphone array 202 is terminated, the control signal generation unit 3043 outputs a control signal to the switch 303 and transmits a speaker's speech signal inputted from the longitudinal circular microphone array 202 to the speech signal discrimination unit 3041. The direction detection unit 304 estimates a speaker's three-dimensional location in the same way as that in step 420 using a speech signal inputted from the longitudinal circular microphone array 202, and thus, the resultant speaker's three-dimensional location is determined, as shown in FIG. 5B.

In step 450, if the speaker's three-dimensional direction is determined, the control signal generation unit 3043 outputs a control signal to the second rotation controller 307 and rotates the super-directional microphone 308 to directly face the speaker's three-dimensional direction.

In step 460, a speaker's speech signal received by the super-directional microphone 308 is converted into a digital signal by the A/D converter 309 and is inputted to the speech signal processing unit 305. The input signal from the super-directional microphone can be used in the speech signal processing unit 305 in a speech enhancement procedure together with a speaker's speech signal received by the longitudinal circular microphone array 202.

Figure 6:
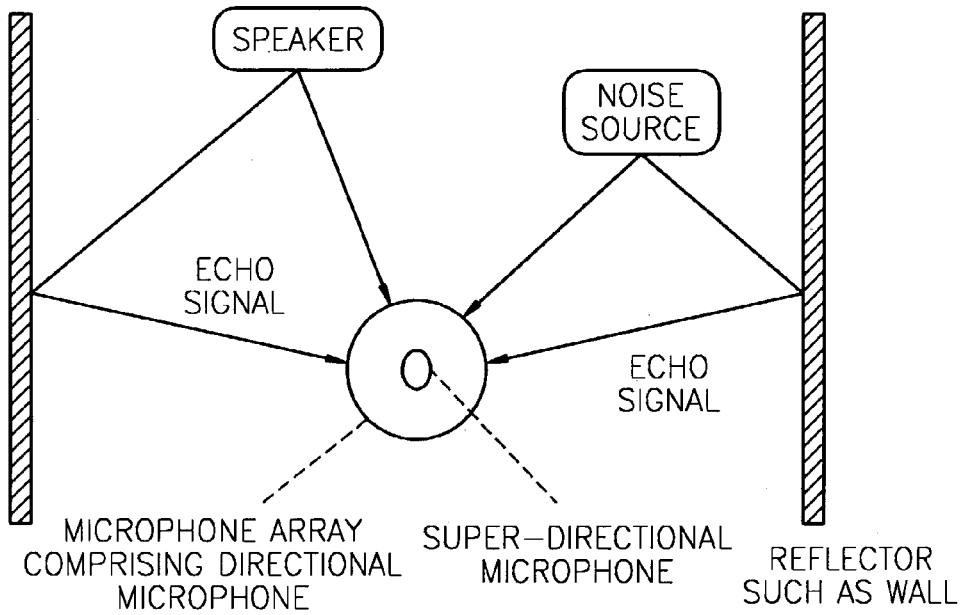
FIG. 6 shows an environment in which the microphone array system according to the present invention is applied.
Figure 7:
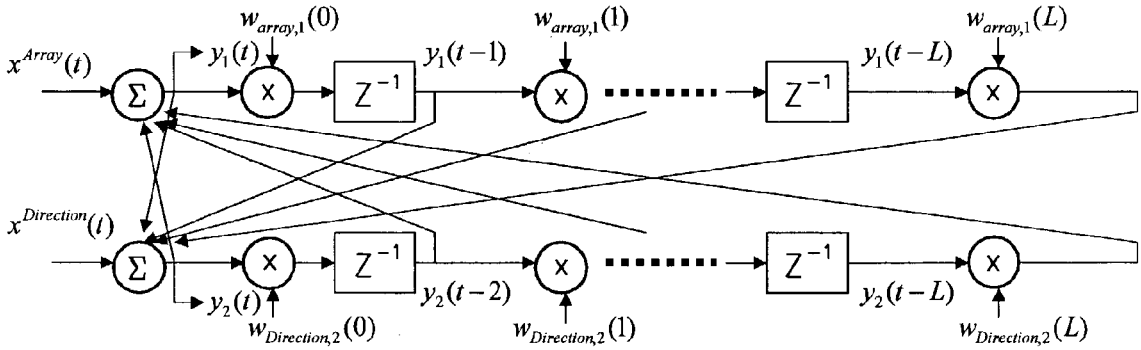
FIG. 7 shows a blind separation circuit for speech enhancement, which separates a speech signal received from a sound source.

A speech enhancement procedure performed in step 460 will be described with reference to FIG. 6 showing an environment in which the present invention is applied, and FIG. 7 showing details of the speech enhancement procedure.

As shown in FIG. 6, the microphone array system according to the present invention receives an echo signal from a reflector such as a wall, and a noise from a noise source such as a machine as well as a speaker's speech signal. According to the present invention, the signal sensed by the super-directional microphone 308 and speech signals received by the microphone array can be processed together, thereby maximizing a speech enhancement effect.

Further, if a speaker's direction is determined and a speaker's speech signal is received by the super-directional microphone 308 by facing the super-directional microphone 308 in the speaker's direction, only a signal received by the super-directional microphone 308 can be processed so as to prevent a noise or an echo signal received by the longitudinal circular microphone array 202 or latitudinal circular microphone array 201 from being inputted to the speech signal processing unit 306. However, if the speaker suddenly changes his location, the same amount of time for performing the above-mentioned steps and determining the speaker's changed location is required, and the speaker's speech signal may not be processed in the time.

To address this problem, the microphone array system according to the present invention inputs a speaker's speech signal received by the latitudinal circular microphone array 201 or longitudinal microphone array 202 and a speech signal received by the super-directional microphone 308 to the blind separation circuit shown in FIG. 7, thereby improving quality of speech of the received speech signal by separating the speaker's speech signal inputted through each microphone and a background noise signal.

As shown in FIG. 7, the speech signal received by the super-directional microphone 308 and a signal received by the microphone arrays are delayed with a time delay of the array microphone for receiving the speaker's speech signal with a time delay, added together, and processed.

In the operation of the circuit shown in FIG. 7, the speech signal processing unit 305 inputs a signal $X^{array}(t)$ inputted from the microphone array and a signal $X^{direction}(t)$ inputted from the super-directional microphone to the blind separation circuit. Two components such as a speaker's speech component and a background noise component, exist in the two input signals. If the two input signals are inputted to the blind separation circuit of FIG. 7, the noise component and the speech component are separated from each other, and thus $y_1(t)$ and $y_2(t)$ are outputted. The outputted $y_1(t)$ and y2(t) are obtained by Equation 5.

$$y_1(t) = x^{array}(t) + \sum_{j+i} \sum_{k=0}^{L} w_{array,j}(k) y_2(t-k) \tag{5}$$

-continued $$y_2(t) = x^{direction}(t) + \sum_{j+i} \sum_{k=0}^{L} w_{direction,j}(k) y_2(t-k)$$

The above Equation 5 is determined by $\Delta W_{array,j}(k) = -\mu\tanh(y_1(t))y_j(t-k)$, $\Delta W_{direction,j}(k) = -\mu\tanh(y_2(t))y_1(t-k)$. Weight w is based on a maximum likelihood (ML) estimation method, and a learned value so that different signal components of a signal are statistically separated from one another, is used for the weight w. In this case, tanh(·) represents a nonlinear Sigmoid function, and μ is a convergence constant and determines a degree in which the weight w estimates an optimum value.

While the speaker's speech signal is outputted, the sound source direction estimation unit 3042 checks from a speaker's speech signal received by the latitudinal circular microphone array 201 and the longitudinal circular microphone array 202 whether a speaker's location is changed. If the speaker's location is changed, step 420 is performed, and thus the speaker's location on the XY plane and the YZ plane are estimated. However, in step 470, if only the speaker's location on the YZ plane is changed according to the embodiment of the present invention, step 440 can be directly performed.

When the speaker's location is not changed, the speech signal discrimination unit 3041 detects whether speaker's speech utterance is terminated, using a method similar to the method performed in step 410. If the speaker's speech utterance is not terminated, in step 480, the speech signal discrimination unit 3041 detects whether the speaker's location is changed.

According to the present invention, the latitudinal circular microphone array and the longitudinal circular microphone array in which directional microphones are circularly arranged at predetermined intervals, are arranged to be orthogonal to each other, and thus, the speaker's speech signal can be effectively received in a multiple direction in which the speaker speaks, in consideration of a speaker's three-dimensional movement as well as a speaker's location which moves in a plane.

Further, if the three-dimensional speaker's location is determined, the directional microphone faces the speaker's direction and receives the speaker's speech signal such that speech recognition is improved by maximizing the received speaker's speech signal, minimizing an ambient noise and an echo signal generated when the speaker speaks, and recognizing speaker's speech more clearly.

In addition, the signal received by the latitudinal circular microphone array or longitudinal circular microphone array and delayed with a predetermined time delay for each microphone as well as the speaker's speech signal received by the super-directional microphone, is outputted together with the signal received by the super-directional microphone, thereby improving an output efficiency.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An orthogonal circular microphone array system for detecting a three-dimensional direction of a sound source, the system comprising:

a directional microphone which receives a speech signal from the sound source;

a first microphone array in which a predetermined number of microphones for receiving the speech signal from the sound source are arranged around the directional microphone;

a second microphone array in which a predetermined number of microphones for receiving the speech signal from the sound source are arranged around the directional microphone so as to be orthogonal to the first microphone array;

a direction detection unit which receives signals from the first and second microphone arrays, discriminates whether the signals are speech signals and estimates the location of the sound source;

a rotation controller which changes the direction of the first microphone array, the second microphone array, and the directional microphone according to the location of the sound source estimated by the direction detection unit; and a speech signal processing unit which performs an arithmetic operation on the speech signal received by the directional microphone and the speech signal received by the first and second microphone arrays and outputs a resultant speech signal.

2. The system as claimed in claim 1, wherein at least one of the first and second microphone arrays has a circular shape.

3. The system as claimed in claim 1, wherein the predetermined number of microphones installed in the first and second microphone arrays are maintained at predetermined intervals.

4. The system as claimed in claim 1, wherein the predetermined number of microphones installed in the first and second microphone arrays are directional microphones.

5. The system as claimed in claim 1, further comprising a switch which selectively transmits a received signal inputted from the first microphone array or a received signal inputted from the second microphone array, to the direction detection unit, according to a control signal of the direction detection unit.

6. The system as claimed in claim 2, wherein the direction detection unit comprises:

a speech signal discrimination unit which discriminates a speech signal from signals received by the first and second microphone arrays;

a sound source direction estimation unit which estimates the direction to a sound source from the speech signal received by the speech signal discrimination unit according to a reception angle of a speech signal received by the microphones installed in the first and second microphone arrays; and a control signal generation unit which outputs a control signal for rotating the first and second microphone arrays to the direction estimated by the sound source direction estimation unit.

7. The system as claimed in claim 6, wherein the sound source direction estimation unit adds output values of a speech signal over a predetermined level inputted to the microphone installed in the first or second microphone array, converts the output values into a frequency region, converts the sum of the output values of the speech signal converted into the frequency region using a reception angle at the microphone of the speech signal as a variable, and estimates the direction of the sound source based on the angle representing the maximum power value.

8. The system as claimed in claim 7, wherein the sum y(t) of the output values of the speech signal over a predetermined level is given by $$y(t) = \sum_{n=1}^{M} x_n\left(t + (n-1)\frac{2r\sin\left(\frac{\pi}{M}\right)\cos\left(\theta + \frac{2\pi(n-1)}{M}\right)}{c}\right),$$

where M is the number of microphones, c is the sound velocity in a medium in which speech is transmitted from a source sound, and r is a distance from the center of an array to the microphone.

9. The system as claimed in claim 1, wherein the speech signal processing unit enhances speech of a desired speech signal by summing speech signals received by each of the microphones installed in the first and second microphone arrays, outputted from the direction detection unit, and delayed with the maximum delay time generated by a location difference between the microphones, delaying a speech signal received by the directional microphone by the maximum delay time, and adding the delayed speech signal to the summed speech signals.

10. A method for detecting a three-dimensional direction of a sound source using first and second microphone arrays in which a predetermined number of microphones are arranged, and a directional microphone, the method comprising:

(a) discriminating a speech signal from signals that are inputted from the first microphone array;

(b) estimating the direction of the sound source according to an angle at which a speech signal is received to a microphone installed in the first microphone array and rotating the second microphone array so that microphones installed in the second microphone array orthogonal to the first microphone array face the estimated direction;

(c) estimating the direction of the sound source according to an angle at which the speech signal is inputted to the microphones installed in the second microphone array;

(d) receiving the speech signal by moving the directional microphone in the direction of the sound source estimated in steps (b) and (c) and outputting the received speech signal; and (e) detecting change of the location of the sound source and whether speech utterance of the sound source is terminated.

11. The method as claimed in claim 10, wherein at least one of the first and second microphone arrays has a circular shape.

12. The method as claimed in claim 10, wherein microphones that are installed in the first and second microphone arrays are maintained at predetermined intervals.

13. The method as claimed in claim 10, wherein microphones that are installed in the first and second microphone arrays are directional microphones.

14. The method as claimed in claim 10, wherein in steps (b) and (c), output values of a speech signal over a predetermined level inputted to the microphone installed in the first or second microphone array are added and converted into a frequency region, the sum of the output values of the speech signal converted into the frequency region is converted based on a reception angle of the speech signal at the microphone, and the direction of the sound source is estimated based on an angle representing a maximum power value in the direction of the sound source.

15. The method as claimed in claim 14, wherein the sum (y) of the output values of the speech signal over a predetermined level is given by $$y(t) = \sum_{n=1}^{M} x_n \left( t + (n-1) \frac{2r\sin\left(\frac{\pi}{M}\right)\cos\left(\theta + \frac{2\pi(n-1)}{M}\right)}{c} \right),$$

where M is the number of microphones, c is the sound velocity in a medium in which speech is transmitted from a source sound, and r is a distance from the center of an array to the microphone.

16. The method as claimed in claim 10, wherein in step (d), speech of a desired speech signal is enhanced by summing speech signals received by each of the microphones installed in the first and second microphone arrays and delayed by the maximum delay time generated by a location difference between the microphones, delaying a speech signal received by the directional microphone by the maximum delay time, and adding the delayed speech signal to the summed speech signals.

* * * * *